US007147312B2

(12) United States Patent
Ujita

(10) Patent No.: US 7,147,312 B2
(45) Date of Patent: Dec. 12, 2006

(54) LIQUID ACCOMMODATION CONTAINER

(75) Inventor: Toshihiko Ujita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 10/886,552

(22) Filed: Jul. 9, 2004

(65) Prior Publication Data

US 2005/0018007 A1 Jan. 27, 2005

(30) Foreign Application Priority Data

Jul. 25, 2003 (JP) ..... 2003-280025

(51) Int. Cl.
*B41J 2/175* (2006.01)

(52) U.S. Cl. ..... 347/86

(58) Field of Classification Search ..... 348/7, 348/19, 86, 87; 349/64
See application file for complete search history.

(56) References Cited

U.S. PATENT DOCUMENTS

| | | | | |
|---|---|---|---|---|
| 3,221,210 | A | 11/1965 | Mullings | 315/82 |
| 5,616,929 | A | 4/1997 | Hara | 250/573 |
| 5,975,665 | A | 11/1999 | Torigoe et al. | 347/7 |
| 6,024,428 | A | 2/2000 | Uchikata | 347/7 |
| 6,137,503 | A | 10/2000 | Hashimoto et al. | 347/19 |
| 6,234,603 | B1 * | 5/2001 | Altfather et al. | 347/19 |
| 6,325,500 | B1 * | 12/2001 | Kitabatake et al. | 347/86 |
| 6,361,136 | B1 | 3/2002 | Watanabe et al. | 347/7 |
| 6,540,314 | B1 | 4/2003 | Sanada et al. | 347/7 |
| 6,917,396 | B1 * | 7/2005 | Hiraishi et al. | 349/64 |
| 2002/0070985 | A1 | 6/2002 | Takagi | 347/7 |

FOREIGN PATENT DOCUMENTS

| | | |
|---|---|---|
| JP | 7-218321 | 8/1995 |
| JP | 7-237300 | 9/1995 |
| JP | 8-112907 | 5/1996 |
| JP | 9-29989 | 2/1997 |
| JP | 10-323993 | 12/1998 |
| JP | 2000-43287 | 2/2000 |
| JP | 2002-321388 | 11/2002 |

* cited by examiner

*Primary Examiner*—Anh T. N Vo
(74) *Attorney, Agent, or Firm*—Fitzpatrick, Cella, Harper & Scinto

(57) ABSTRACT

A prism of an ink tank has a function for reflecting light, which is incident from the outside, to the outside when no liquid is present in a liquid chamber and not reflecting the light, which is incident from the outside, to the outside when a liquid is present in the liquid chamber, and when the optical characteristics of a material constituting the liquid accommodation container are measured based on a standard according to JIS K7105, the material has optical characteristics equivalent to such optical characteristics that a transmittance of all light beams is 80% or more and a Haze value is equal to or more than 75% and equal to or less than 85%. With the above arrangement, there can be provided an ink tank, which can be operated stably and detect a remaining amount of ink, at a low price.

11 Claims, 10 Drawing Sheets

LIQUID ACCOMMODATION CONTAINER

This application claims priority from Japanese Patent Application No. 2003-280025 filed on Jul. 25, 2003, which is hereby incorporated by reference.

BACKGROUND OF THE INVENTION

1. Field of the Invention

The present invention relates to a structure of a liquid accommodation container for accommodating ink and the like, and more particularly, to an ink tank of a recording apparatus on which a cartridge, which includes a recording head for executing recording according to an ink jet system and the ink tank for supplying ink to the recording head, is mounted.

2. Description of the Related Art

There has been known an arrangement disclosed in, for example, Japanese Patent Application Laid-Open No. H8-112907 as a method of detecting a remaining amount of ink or the presence or absence of ink in an ink tank (liquid accommodation container) for accommodating a liquid such as ink and the like, that is, as a method of optically detecting the presence of ink. Japanese Patent Application Laid-Open No. H8-112907 discloses an ink jet recording apparatus employing a method of causing light to pass through a part of a wall surface of a light transmitting ink tank and detecting the change of a light reflectance in an interface between the wall surface and a negative pressure generation member in order to detect a remaining amount of ink in an ink tank having the negative pressure generation member such an absorbent, a foaming agent, and the like and.

Japanese Patent Application Laid-Open No. H7-218321 discloses an ink tank having an optical ink detector which is formed of the same light transmitting material as that of an ink tank and the interface of which to ink has a predetermined angle with respect to a light path.

Japanese Patent Application Laid-Open No. H9-29989 discloses an ink jet recording apparatus that can detect the presence or absence of ink and the presence or absence of an ink tank by a set of an optical sensor using an light emitting device and a light receiving device.

Further, Japanese Patent Application Laid-Open No. 2002-321388 discloses an arrangement that a member, which has two slanting surfaces forming a predetermined angle is disposed on one of walls constituting an ink tank at a position where the member is in contact with ink. In the above arrangement, an amount of ink can be securely detected by changing an amount of light, which is irradiated to the ink tank from the outside thereof and reflected to the outside, by the two slanting surfaces depending on an ink absence state and an ink presence state.

The two slanting surfaces described above are conveniently called a prism portion in the following description because they optically function as a so-called prism when ink is absent, and an ink amount detection system employing light reflected by the prism portion is conveniently called a prism detection mechanism in its entirety in the following description.

FIGS. 7A and 7B show a conventional embodiment of an ink tank on which a prism is mounted, wherein FIG. 7A is a sectional view showing an overall arrangement of the prism, and FIG. 7B is a sectional view taken along the line 7B—7B in FIG. 7A.

The ink tank is a liquid accommodation tank having a negative pressure generation member accommodation chamber 14, a liquid accommodation chamber 17, and further a prism 20. The negative pressure generation member accommodation chamber 14 accommodates a negative pressure generation member 11 as well as includes a liquid supply port 12 and an atmosphere communication unit 13, the liquid accommodation chamber 17 has a communication unit 15 for communicating with the negative pressure generation member accommodation chamber 14 as well as forms an substantially hermetically sealed space, and the prism 20 detects the presence or absence of a liquid 16 accommodated in the liquid accommodation chamber 17.

A prism detection mechanism composed of the prism 20 shown in FIGS. 7A and 7B will be explained in detail with reference to FIG. 8.

FIG. 8 is a view showing an example of a positional relationship among the light transmission type prism 20 disposed on the bottom 21 of the ink tank, a light emitting device 22 for irradiating light to the prism 20, and a light receiving device 23 for receiving the light.

As shown in FIG. 8, the prism 20 is molded integrally with the ink tank and disposed on the bottom 21 thereof. Although the ink tank has a basic wall thickness of 1.7 mm to 2.0 mm, the prism 20 has such a sectional shape that the 90° apex thereof protrudes into the ink tank by a height of 3.2 mm (FIG. 7B).

The light emitted from the light emitting device 22 is incident on the prism 20 from below a lower portion of the ink tank.

When the ink tank is filled with a sufficient amount of ink so that the ink is in contact with the surface of the prism 20, the light incident on the prism 20 is absorbed into the ink through light paths (1) and (2') and does not return to the light receiving device 23. In contrast, when the ink in the ink tank is consumed in such an amount that it is not in contact with the surface of the prism 20, the incident light is reflected by a slanted surface of the prism 20 that acts as the interface thereof with the ink and reaches the light receiving device 23 through the light path (1) and light paths (2) and (3) as shown in FIG. 8. Presence or absence of the ink is detected by whether or not the light emitted from the light emitting device 22 returns to the light receiving device 23.

Note that the light emitting device 22 and the light receiving device 23 are ordinarily disposed on a recording apparatus body side.

Further, in an actual system, a threshold value is provided in consideration of the effect of background light, and the like, and presence or absence of ink is ordinarily determined depending on whether or not the threshold value is exceeded.

Japanese Patent Application Laid-Open No. H10-323993 proposes an example of an arrangement for coping with the effect of background light. In the arrangement, a recess is formed on the bottom, which corresponds to a prism, of an ink tank in order to improve a drawback that presence or absence of ink cannot be accurately detected. The drawback occurs because the light emitted from a light emitting device is directly reflected on the bottom of the ink tank, on which the prism is disposed, and thus the light receiving device detects the light in an amount larger than an amount which is supposed to be received. According to the arrangement, an amount of the emitted light, which is reflected by the bottom and directly reaches the light receiving device, is reduced because the reflected light path of the emitted light is disturbed by the recess, thereby the effect of the reflected light to the light receiving device can be decreased.

It can be said that the prism detection mechanism explained above is a very reasonable method as a method of detecting a level or presence or absence of the ink in an ink tank.

In recent years, however, it is required to provide a high quality ink jet recording apparatus at low price.

Ink amount detection means including the prism detection mechanism warns run out of ink which occurs sometimes and does not determine the fundamental capability of a recording apparatus such as print quality, a print speed, and the like. However, provision of the ink amount detection mechanism is very effective to save ink, sheets, and time by preventing reattempt of printing due to the run out of ink.

As a result, the ink amount detection mechanism has been supported by users because they recognize the importance thereof.

In contrast, it is true that the ink amount detection mechanism has a significant influence on the manufacturing cost of a recording apparatus and an ink tank because it requires a precise mechanism and the number of parts is increased, and thus the quality of a manufacturing processes must be enhanced. This problem will be explained below in detail.

Ordinarily, although a light emitting unit and a light receiving unit is commercially available as an integral part, a light sensor unit composed of a combination of independent parts may be employed.

In any of the cases, the light receiving unit and the light emitting unit are fixed with a predetermined interval set therebetween, and the interval is conveniently called a lens interval 30 of a light sensor.

As shown in FIG. 9, a first slanting surface 31 of two slanting surfaces of a prism of an ink tank confronts the light emitted from a light emitting device 22 at an angle of 45°, and a second slanting surface 32 is formed at an angle of 90° with respect to the first slanting surface 31 and confronts the light receiving device 23 at an angle of 45°.

The light emitted from the light emitting device 22 is reflected by the first slanting surface 31 at an angle of 90° and reaches the second slanting surface 32. However, it is important that the distance 33 from a light reflecting portion 36 on the first slanting surface 31 to the intersecting point at which the line from the light reflecting portion 36 intersects a prism center line 35, which is obtained by equally dividing the apex of the prism, at a right angle be equal to the distance 34 from a light reflecting portion 37 on the second slanting surface 32 to the intersecting point at which the line from the light reflecting portion 37 intersects the prism center line 35 at a right angle as far as possible.

An ideal light path from the light emitting device 22 of the sensor to the light receiving device 23 thereof through the prism 20 is called an optical axis.

FIG. 10 shows a case where the center of the light path (optical axis) is deviated right from the prism center line 35 by an amount of offset (deviation) 41. The deviation is not caused intentionally but is an indispensable deviation due to the accuracy of sensor parts, the mounting accuracy of the sensor parts, and the positional accuracy and the mounting accuracy of the prism resulting from the ink tank being mounted.

As shown in FIG. 10, the light emitted from the light emitting device 22 is displaced from the optical axis of the light receiving device 23 due to the occurrence of deviation of the optical axis (optical axis deviation) 42. In a triangular prism as the prism 20, an amount of deviation 42 of the optical axis of the light receiving device is theoretically twice as large as the amount of deviation 41.

Accordingly, to permit the light receiving device 23 to effectively receive light, the intermediate axis of the lens interval 30 must be disposed in alignment with the prism center line 35 more accurately.

When the intermediate axis is deviated from the prism center line 35 as described above, even if the recess is formed on the bottom of the ink tank where the prism is disposed as disclosed in Japanese Patent Application Laid-Open No. H10-323993, this arrangement cannot cope with the deviation because it is not an arrangement for compensating the deviation.

FIG. 11 explains the relationship between the amount of deviation of the light sensor described above and the distribution of intensity of light that reaches the light receiving sensor.

According to the FIG. 11, when the amount of deviation (offset) is zero, that is, when the optical axis of the sensor is perfectly in alignment with the center of the prism 20, the intensity of reflected light has a value greatly larger than the threshold value for determining ink presence and absence.

However, an increase in the amount deviation abruptly decreases an amount of received light, and when the amount of deviation is in the range less than a portion "a" and in the range larger than a point "b" in FIG. 11, the intensity of reflected light has a value less than the threshold value, and thus the ink presence and absence cannot be correctly determined.

Since the ink tank is mounted on a moving portion of an ink jet recording apparatus, in particular, on a carriage in many cases, it must be aligned with a pinpoint accuracy.

Further, the position of the prism must be accurately determined from the position of the ink tank determined with respect to the ink jet recording apparatus.

Further, the prism must be formed in a precise shape because it is an optically precise prism.

To satisfy the above requirements, it is strictly required to assemble the parts and the mechanisms of the prism with a pinpoint accuracy and further it is important to confirm the quality of them, thereby the cost of the prism is inevitably increased.

As ink jet recording apparatuses are miniaturized more and more in recent years, a space, which can be occupied by a prism in an ink tank, becomes very small. Accordingly, when a polygonal prism is employed, one side thereof has a very narrow size, from which an amount of deviation that is allowed to the polygonal prism with respect to an optical axis is actually smaller than that of a triangular prism.

Almost all the ink tanks for the ink jet recording apparatuses are formed of a relatively less expensive plastic by ordinary injection molding. It is very difficult to accurately mold an optical prism having a complex shape as described above by the injection molding. This is because that since the wall thickness of a prism portion is lager than that of other portions, a sink mark occurs in the prism portion because the resin is shrunk after it is molded in the plastic injection molding method. Since the surface shape of the prism portion is made uneven by the sink mark, the optical function thereof is deteriorated by it.

To prevent the sink mark, a space called a relief is ordinarily formed in a molded product, the relief cannot be freely designed because it must be formed at a position offset from an optical path.

Although some plastics are less shrunk in molding and can be selected as materials for overcoming the problem of sink mark described above without the relief, their cost is very expensive.

Further, when a plastic is selected as a material, since the chemical stability of the material to ink must be also taken into consideration, a range of selectable materials is greatly limited.

According to the knowledge of the inventors, an olefin resin is most preferable as a material which has good balance in reasonable price, chemical stability, and moldability as well as permits light to pass therethrough.

Further, a polypropylene resin is most suitable when injection moldability and mechanical rigidity are taken into consideration.

Further, as an another means, a trial for increasing an amount of emitted light was also executed to secure a sufficient amount of light even if an optical axis is deviated with respect to an ink jet recording apparatus.

However, when the amount of emitted light is increased immoderately as shown in FIG. 12, an amount of background reflection 70 is increased by irregular reflection in the ink tank when ink exists therein and background reflected light reaches the light receiving device, from which an error region 71 occurs and an erroneous determination that "ink is absent" is made thereby.

To construct a user-friendly ink jet recording apparatus as described above, it is indispensable to provide a mechanism for detecting an amount of ink remaining in the ink tank with the apparatus, and the optical remaining amount detection mechanism using the prism is excellent from the relationship between cost and reliability.

However, it has been difficult to more reduce the cost of the optical remaining amount detection mechanism using the prism because the number of parts is increased to cope with a requirement for a pinpoint accuracy and the quality thereof must be sufficiently managed.

SUMMARY OF THE INVENTION

An object of the present invention, which was devised to overcome the conventional cost increasing problem in order to construct the prism remaining amount detection mechanism described above, is to provide a low price ink jet recording apparatus with users as a result that an ink tank (liquid accommodation container), which is less expansive and can detect a remaining amount of ink while operating stably, can be provided. More specifically, an object of the present invention is to provide a highly reliable ink tank at low cost which can detect a remaining amount of ink in an exchangeable ink tank which supplies ink to an ink jet recording head and has an optical reflection mechanism for detecting the remaining amount of ink.

To achieve the above object, the present invention relates to a liquid accommodation container for accommodating a liquid which includes walls for constituting the liquid accommodation container, a liquid accommodation chamber formed in the liquid accommodation container, a liquid supply port formed through one of the walls of the liquid accommodation container for supplying the liquid accommodated in the container to the outside, and an optical member disposed on the one of the walls, wherein a part of the optical member faces inward of the liquid accommodation chamber and has a function for reflecting light, which is incident from the outside, to the outside when no liquid is present in the liquid accommodation chamber and not reflecting the light, which is incident from the outside, to the outside when the liquid is present in the liquid accommodation chamber, and when the optical characteristics of a material of the liquid accommodation container are measured based on a standard according to JIS K7105, the material has optical characteristics which are equivalent to the optical characteristics that a transmittance of all light beams is 80% or more and a Haze value is equal to or more than 75% and equal to or less than 85%.

A measured sample is a rectangular parallelepiped which constitutes the liquid accommodation container and has a square cross section with each side of 40 mm and a thickness of 1.7 mm.

In the above liquid accommodation container, the optical member is molded integrally with the liquid accommodation container.

The optical member is a member having two reflection surfaces.

It is preferable to exhibit the optical characteristics of the present invention by subjecting the surface of the optical member to a non-mirror-finished surface treatment.

It is preferable to exhibit the optical characteristics of the present invention by bonding a light dispersing sheet on the surface of the optical member.

It is preferable that the optical member is composed of an olefin resin material containing no clearing agent.

The liquid accommodation container includes a negative pressure generation member accommodation chamber for accommodating a negative pressure generation member and having a liquid supply port and an atmosphere communication unit, a liquid accommodation chamber having a communication unit for communicating with the negative pressure generation member accommodation chamber as well as forming a substantially hermetically sealed chamber, and an optical member for detecting the presence or absence of a liquid accommodated in the liquid accommodation chamber, wherein ink is poured into the liquid accommodation container such that at least the optical member is dipped in the ink.

According to the invention described above, the optical member has such characteristics as to gently changing the intensity of light (FIG. 2) so that the light emitted from a light emitting device of a light sensor is reflected by the optical member while being scattered thereby and incident on a light receiving device of the light sensor. Accordingly, even if a light path (so-called optical axis), which is uniquely determined from the light emitting device to the light receiving device passing through the optical member, is displaced by the influence of a part accuracy and a mounting accuracy, a position alignment accuracy of the light sensor and the liquid accommodation container is eased. With the above arrangement, a remaining amount of a liquid can be more securely detected, and it is not necessary to enhance the position alignment accuracy using a costly means.

According to the present invention, presence or absence of the liquid remaining in the liquid accommodation container can be sufficiently detected even if the light sensor is not in alignment with the optical axis of the optical member by scattering the light emitted from the light sensor by the optical member. As a result, parts and systems can be simplified, and an ink tank by which the remaining amount can be detected with high reliability can be provided at a low price.

BREIF DESCRIPTION OF THE DRAWINGS

DETAILED DESCRIPTION OF THE PREFERRED EMBODIMENTS

Figure 7B:
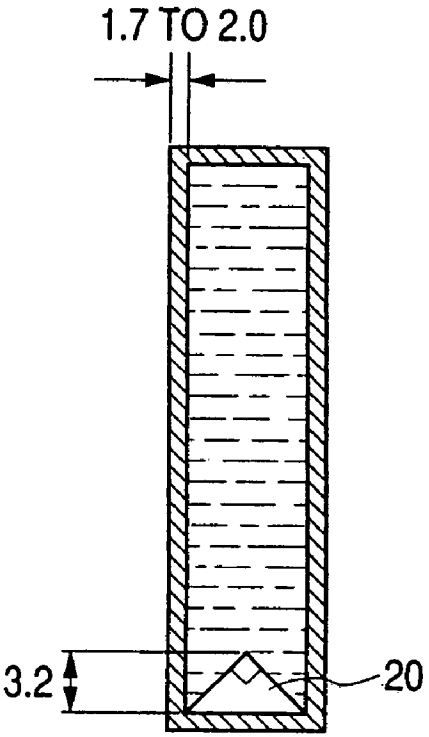
FIG. 7B PRIOR ART
FIGS. 7A and 7B are views showing an example of a conventional arrangement of an ink tank on which a prism is mounted.
Figure 7A:
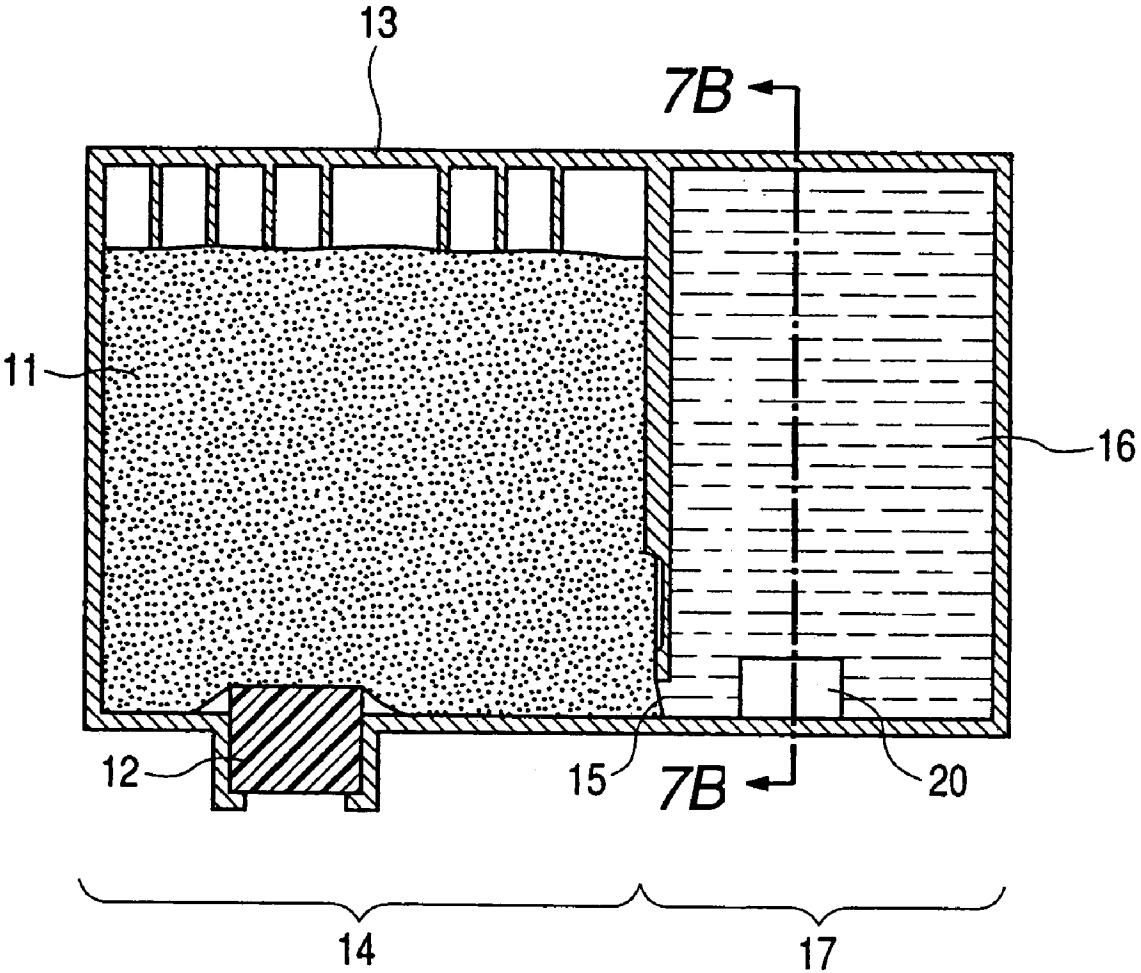
FIG. 7A PRIOR ART

Embodiments of the present invention will be explained below with reference to the drawings. The arrangement of a prism, which is a feature of the present invention, will be mainly explained by omitting the explanation of the arrangement of an ink tank of the embodiments because it is arranged similarly to that shown in FIGS. 7A and 7B described above.

(First Embodiment)

Table 1 shows the optical characteristics of a material constituting an ink tank and a prism of a first embodiment of the present invention, the optical characteristics of a material constituting a conventional ink tank, and the dimensions of the respective prisms.

The optical characteristics of the materials constituting the ink tanks were measured according to JIS K7105. Note that since it was difficult to measure the optical characteristics of the material of a prism portion of the ink tank due to its shape, they were measured as to the wall portion constituting the ink tank other than the prism portion. The wall of the ink tank measured in the embodiment had a thickness "t" of 1.7 mm.

TABLE 1

| | Prism height | Transmittance of all light beams | Diffusion ratio | Haze value |
|---|---|---|---|---|
| Conventional container material | 3.2 mm | 81% | 22% | 27% |
| Vessel material of Embodiments | 3.2 mm | 88% | 70% | 80% |

It can be found that the material used in the embodiments is a resin having a feature that it has a high light transmitting property and that light is liable to be scattered in the resin.

A principle why the embodiments are effective to solve the problems will be explained below.

Figure 1:
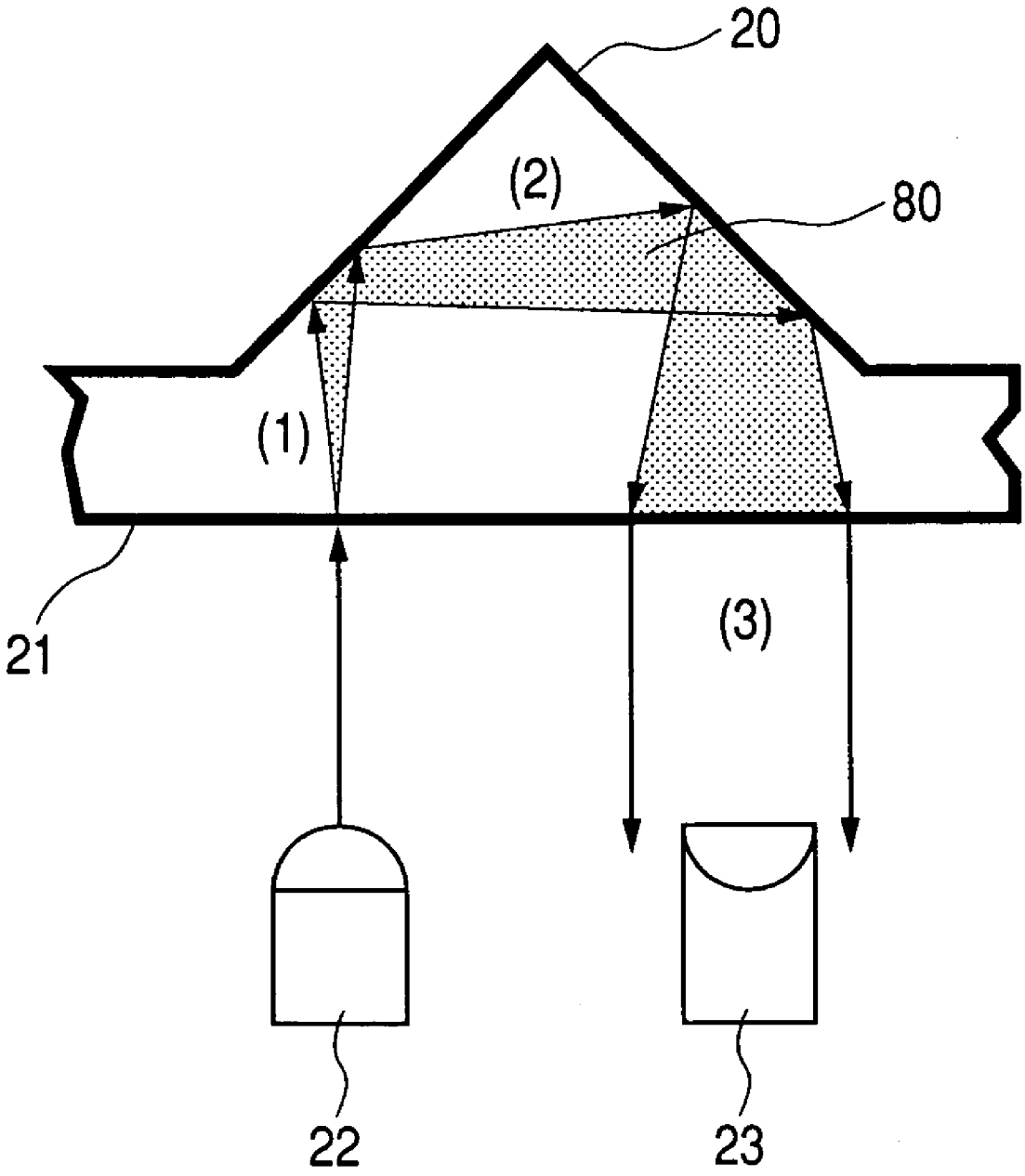
FIG. 1 is a view explaining a behavior of light in a prism of an ink tank according to a first embodiment of the present invention.

FIG. 1 shows a behavior of light traveling in the prism of the ink tank according to the first embodiment of the present invention. As shown in FIG. 1, the light, which has entered into the prism, is dispersed in a large region by the occurrence of appropriate scattering light 80 although its intensity is reduced. As a result, the region, in which prism refection can be used, is increased.

Figure 2:
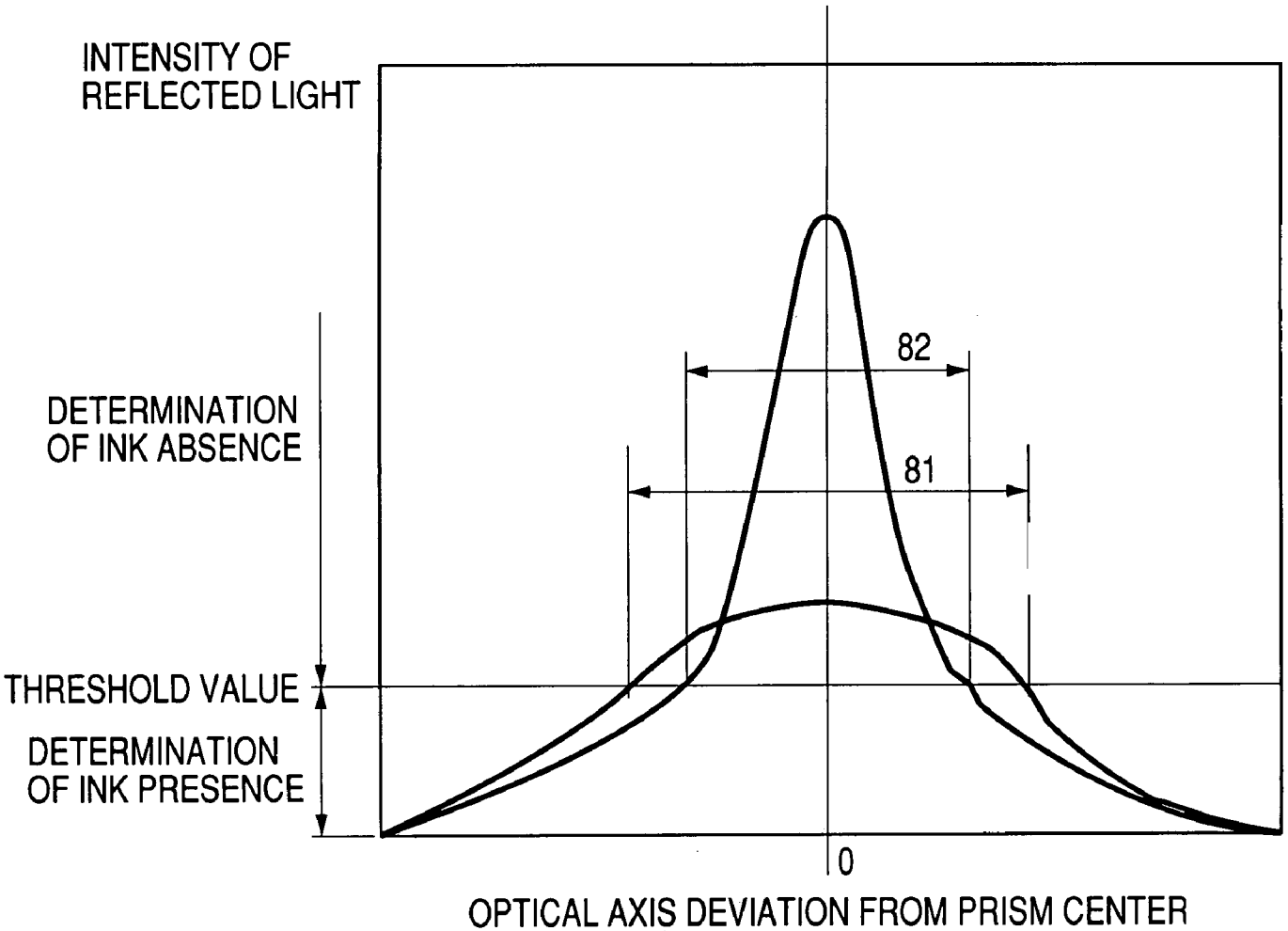
FIG. 2 is a view explaining prism characteristics in the first embodiment of the present invention.

FIG. 2 shows a comparison between the characteristics of a prism composed of a conventional material having high transparence and those of a prism composed of the material of the embodiments. A "threshold value" in the figure shows the intensity of reflected light for determining ink presence and absence.

The conventional material is an olefin resin material containing a clearing agent, and the material of the embodiment is an olefin resin material containing no clearing agent.

FIG. 2 shows a deviation of optical axis which can be recognized when ink is absent by a conventional allowable value 82 and an allowable value 81 of the embodiment.

As apparent from FIG. 2, it can be found that since the feature of the prism having the characteristics of the embodiment resides in that a remaining amount of ink can be detected in a larger range as a result that the intensity of light gently changes with respect to the deviation of the optical axis deviation between an optical sensor and the prism.

According the examination executed by the inventors, when a test piece, which acts as a prism material, has a square cross section with each side of 40 mm, a thickness (height) of 1.7 mm, and a Haze value, which shows a degree of cloud, equal to or larger than 90%, the intensity of light that reaches a sensor is extremely weak. This problem can be solved by reducing the threshold value for determining the ink presence and absence. In this case, however, a malfunction may occur because background light other than the light emitted by a sensor is liable to be collected.

Figure 8:
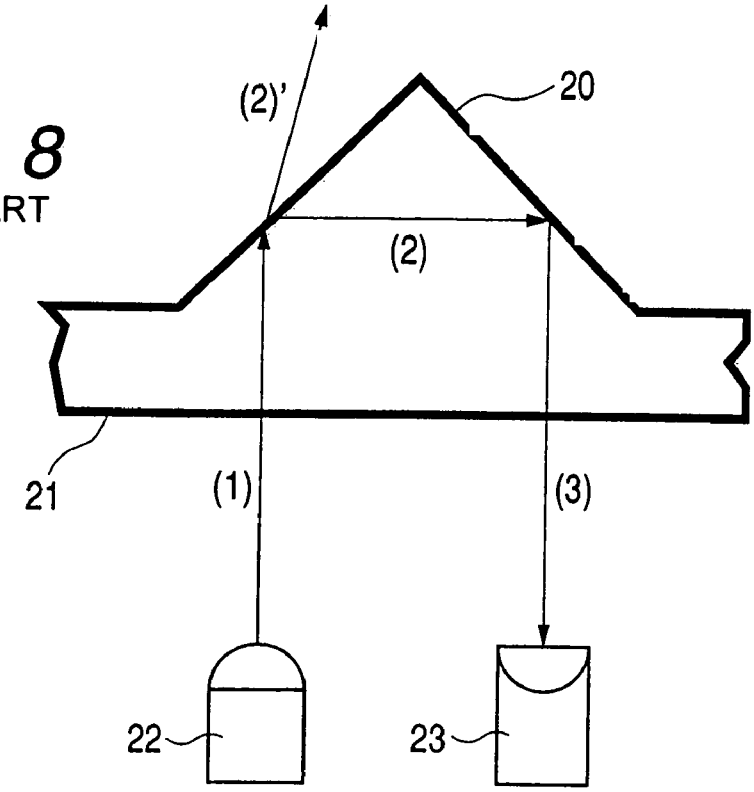
FIG. 8 PRIOR ART
FIG. 8 is a view explaining the relationship between a prism and a sensor each having a conventional arrangement.
Figure 9:
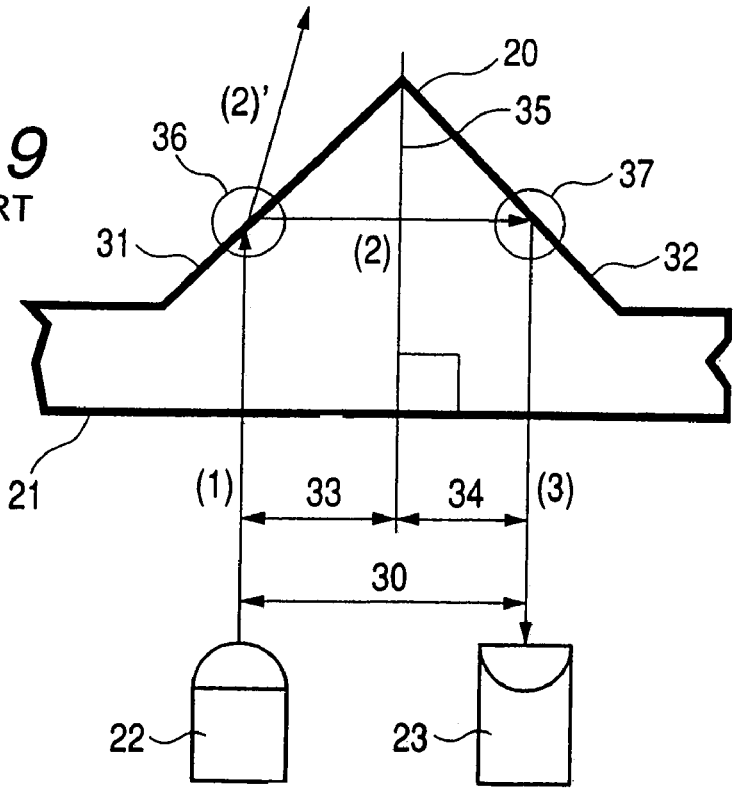
FIG. 9 PRIOR ART
FIG. 9 is a view explaining detection of an amount of ink detected by the prism having the conventional arrangement.
Figure 10:
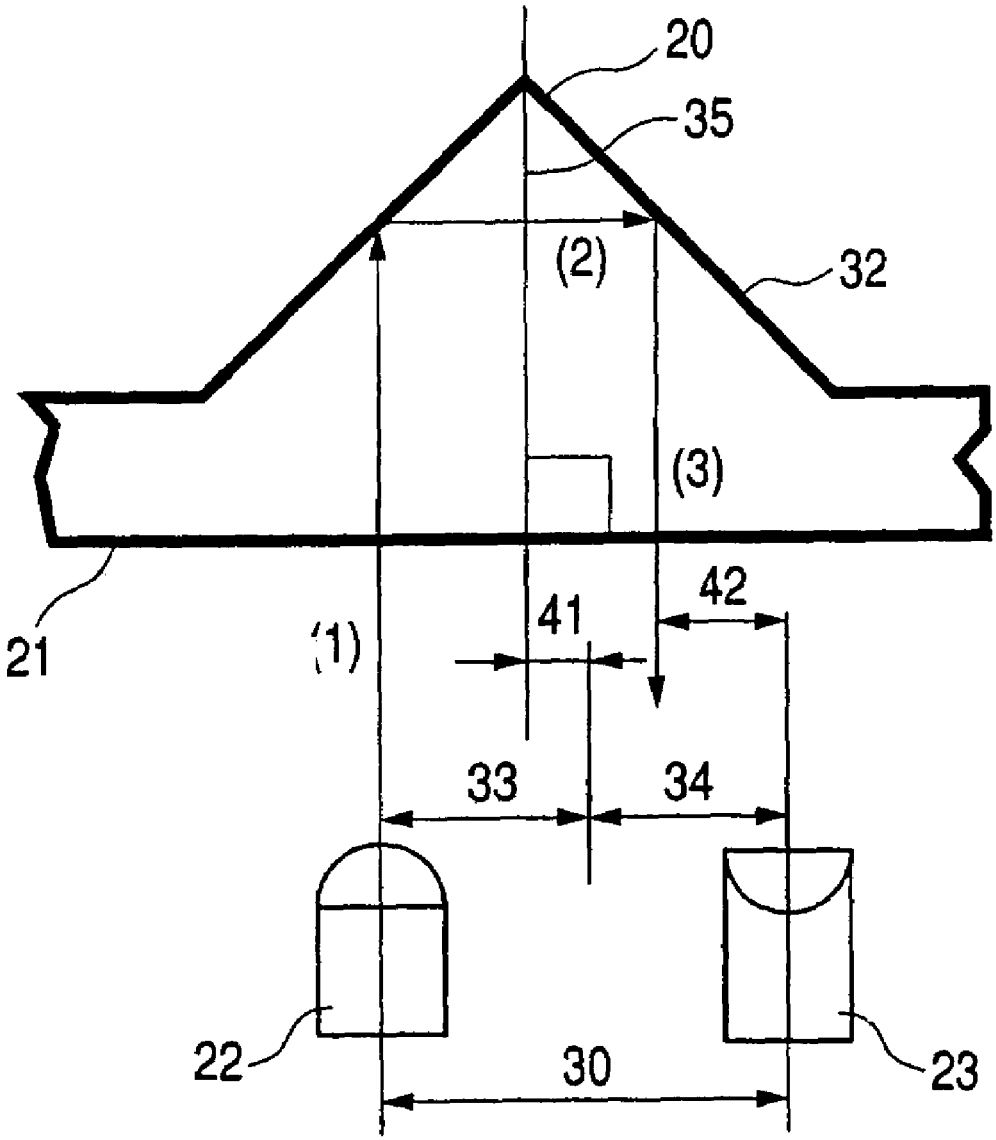
FIG. 10 PRIOR ART
FIG. 10 is a view explaining problems when an amount of ink is detected by the prism having the conventional arrangement.
Figure 11:
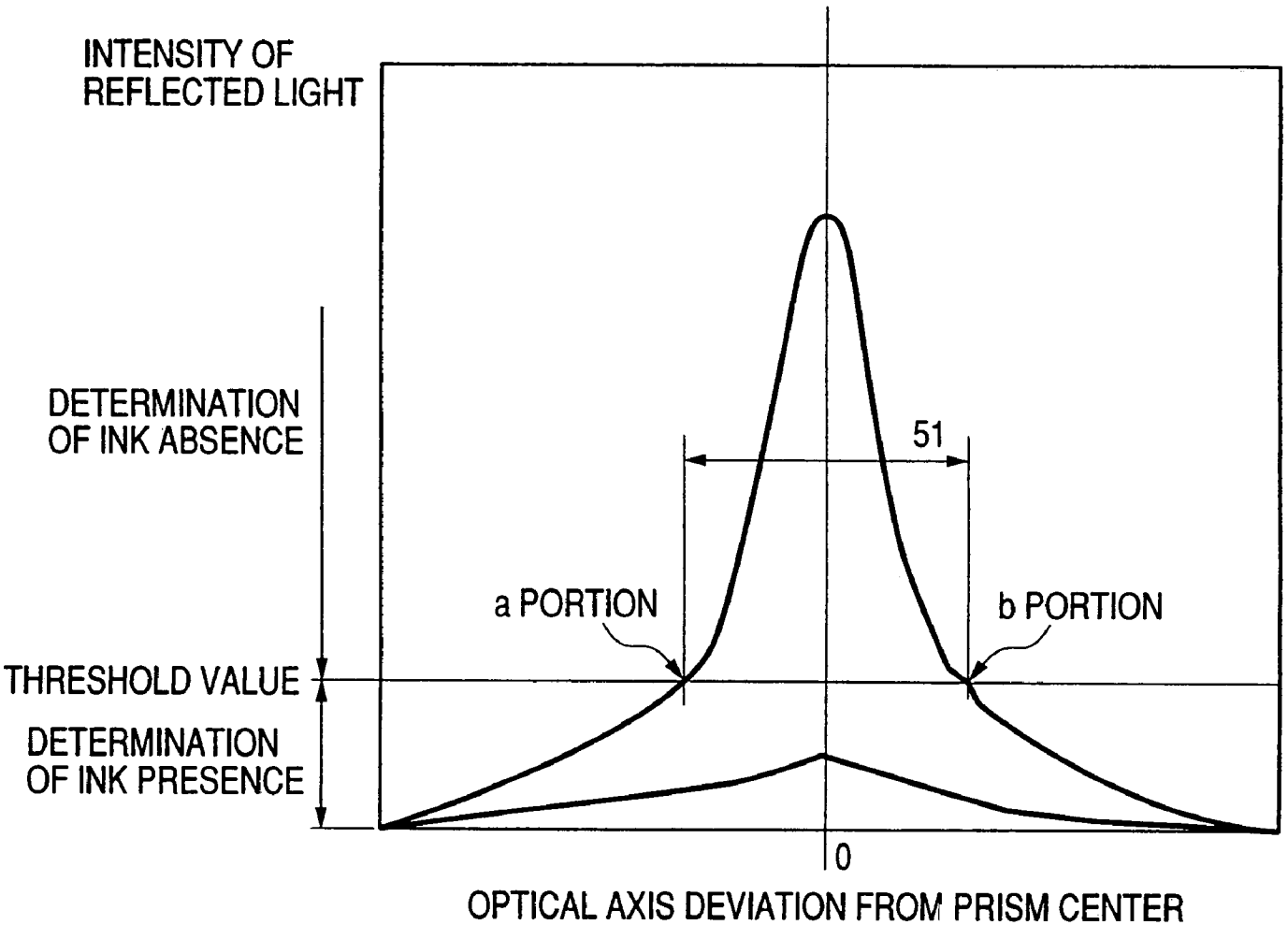
FIG. 11 PRIOR ART
FIG. 11 is a graph showing the relationship between an amount of deviation of an optical axis and the distribution of intensity of light that reaches to a light receiving sensor.
Figure 12:
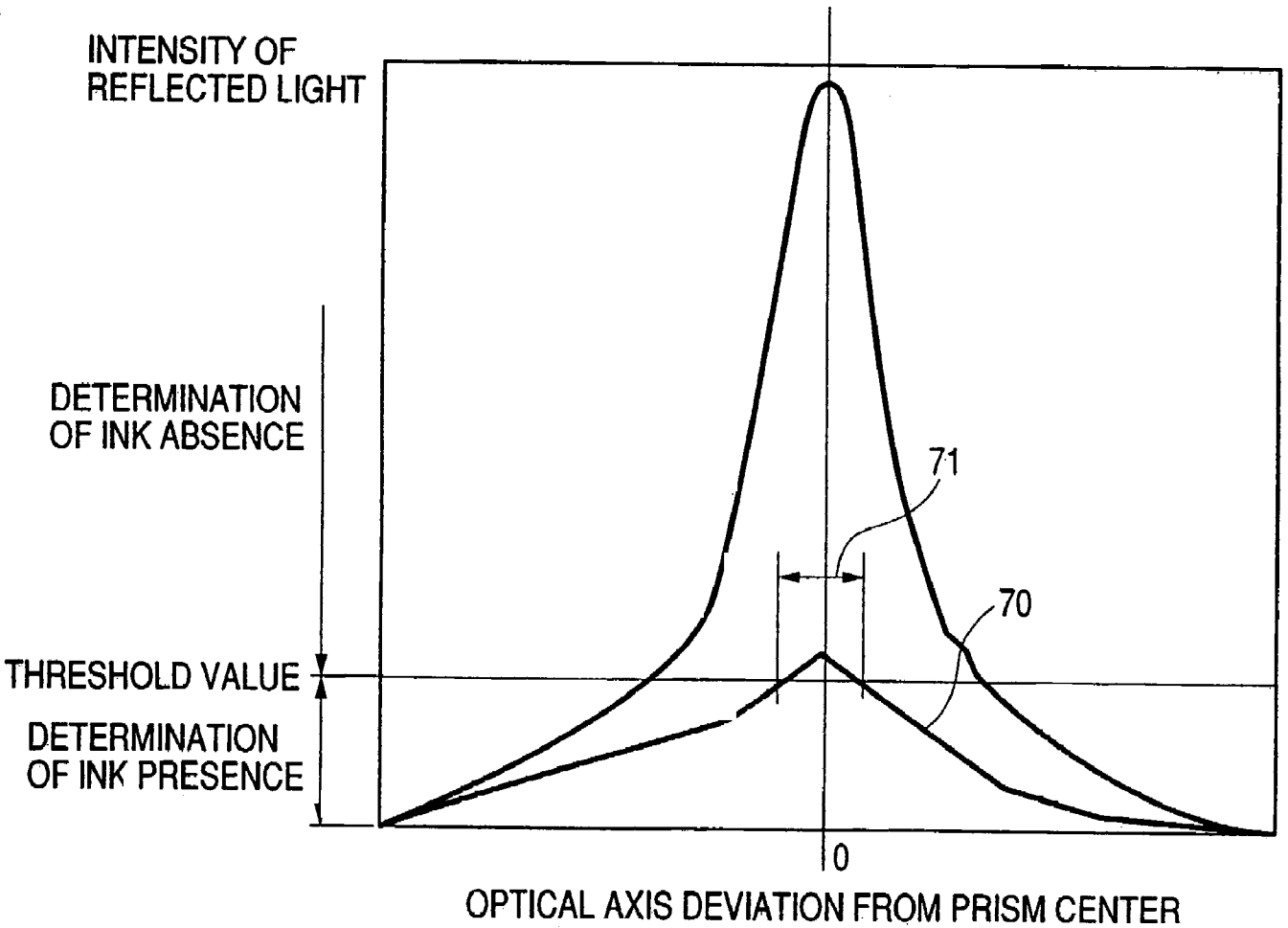
FIG. 12 PRIOR ART
FIG. 12 is a view explaining a drawback when an amount of emitted light is increased.

Further, when the Haze value is extremely increased, a defect occurs in that an amount of ink cannot be visually confirmed from the outside. Although the visual confirmation of the amount of ink does not directly relate to the present invention, it is a very important factor for the confirmation of reliability that a user can confirm the amount of ink by his or her eyes in actual use, in addition to that it is detected by the apparatus. Further, when the Haze value is equal to or less than 70%, light is less scattered and the characteristics of the prism become near to the characteristics of the conventional prism shown in FIG. 8 described above. Accordingly, it is necessary that the Haze value be larger than 70% and less than 90% and preferably be equal to or larger than 75% and equal to or less than 85%.

Further, when the transmittance of all light beams is equal to or less than 75%, since light itself is absorbed into the prism, the transmittance of all light beams is preferably 80% or more.

(Second Embodiment)

Figure 3:
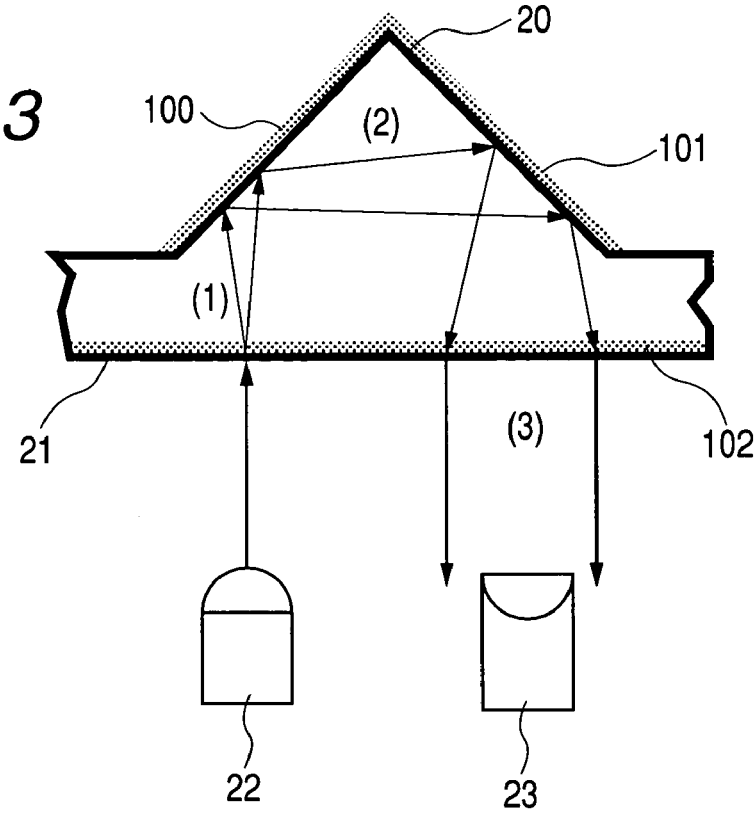
FIG. 3 is a view explaining a behavior of light in a prism of an ink tank according to a second embodiment of the present invention.

FIG. 3 shows a behavior of light traveling in a prism 20 of an ink tank according to a second embodiment of the present invention.

The second embodiment shows an example that light is scattered while maintaining the degree of transparence of a material itself constituting the prism 20 to a conventional value (for example, a Haze value of 27%).

The second embodiment intends to disperse light by intentionally reducing the degree of flatness of the surfaces 100, 101, and 102 of the prism 20. When the prism 20 is formed of plastic by injection molding, the prism 20 can be formed in a shape, which can disperse light on the surfaces thereof, by a design of a metal mold. The portions of the prism 20, which are subjected to a non-mirror-finished surface treatment and formed to rough surfaces, are the surfaces 100 and 101 that are two slanting surfaces thereof and at least the surface 102 of the wall of the ink tank which corresponds to the portion of the ink tank where the prism 20 is formed.

It is supposed that a test piece, which has been subjected to the same treatment, has a square cross section with each side of 40 mm, a thickness of 1.7 mm, has a transmittance of all light beams of 80% or more and a Haze value equal to or more than 75% and equal to or less than 85% as a result of measurement of the optical characteristics thereof executed based on a standard according to JIS K7105. When a prism having optical characteristics equivalent to the above optical characteristics is formed, the same effect as the first embodiment can be obtained. Further, the second embodiment is advantageous also in that the dispersion of light can be easily adjusted in design because it can be controlled by the shape of the metal mold.

(Third Embodiment)

Figure 4:
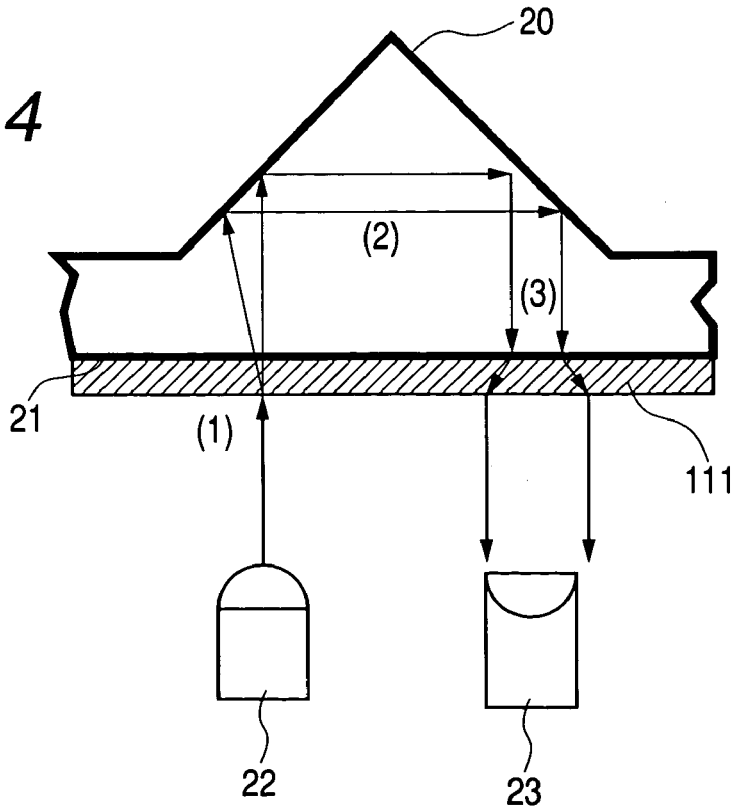
FIG. 4 is a view explaining a behavior of light in a prism of an ink tank according to a third embodiment of the present invention.

FIG. 4 shows a behavior of light traveling in a prism 20 of an ink tank according to a third embodiment of the present invention.

In the third embodiment, a light dispersing sheet 111 for dispersing light is disposed on the portion of the bottom 21 of the ink tank which corresponds to at least the prism 20. The basic structure of the ink tank is the same as that of the conventional ink tank (refer to FIGS. 7A and 7B), and the dispersion of light can be finely adjusted by selecting the light dispersing sheet 111 bonded to the prism 20 depending on a type and sensitivity of the sensors of a light emitting device 22 and a light receiving device 23 and on a threshold value for determining ink presence and absence.

It is supposed that a test piece, which has a square cross section with each side of 40 mm and a thickness of 1.7 mm and to which the above sheet is bonded, has a transmittance of all light beams of 80% or more and a Haze value equal to or more than 75% and equal to or less than 85% as a result of measurement of the optical characteristics thereof executed based on the standard according to JIS K7105. When a prism having optical characteristics equivalent to the above optical characteristics is formed, the same effect as the first embodiment can be obtained.

The third embodiment has an advantage in that it is suitable for a small item production and that and can be customized to various ink tanks in a short preparation time.

(Fourth Embodiment)

Figure 5:
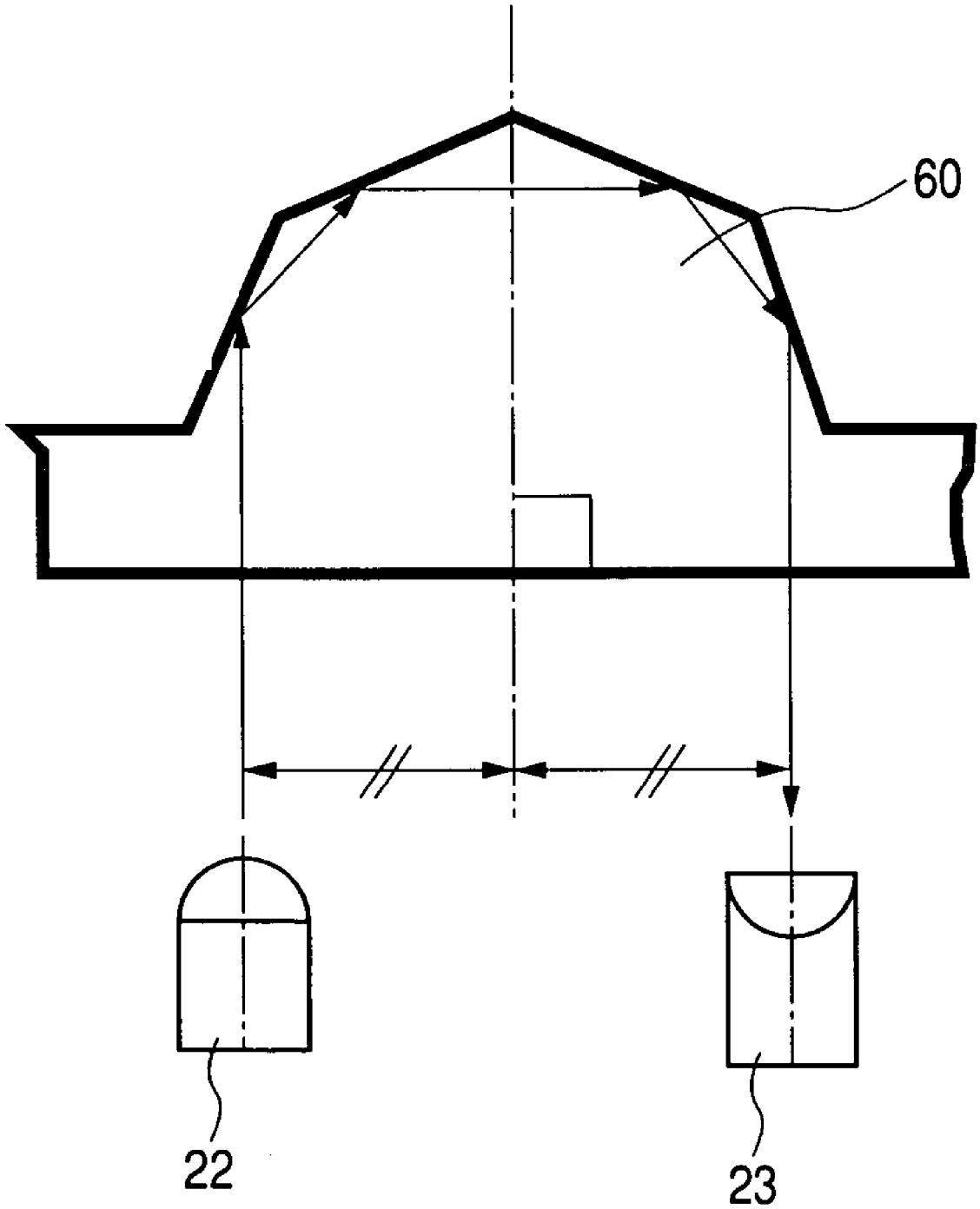
FIG. 5 is a view explaining a behavior of light in a prism of an ink tank according to a fourth embodiment of the present invention.

FIG. 5 shows a behavior of light in a prism 60 of an ink tank according to a fourth embodiment of the present invention.

In the fourth embodiment, the prism 60 has an optically reflecting portion having four surfaces in place of a conventional triangular shape. The prism 60 is formed of a material, which has a square cross section with each side of 40 mm, a thickness of 1.7 mm, and such optical characteristics that a transmittance of all light beams is 80% or more and a Haze value is equal to or more than 75% and equal to or less than 85% when they are measured based on the standard according to JIS K7105.

The fourth embodiment is effective when, for example, the optically reflecting portion requires a mechanical strength.

As described above, in the explanation of the fourth embodiment, the optical characteristics of a prism portion acting as the optically reflecting portion are characterized by the numerical values obtained by measuring the optical characteristics of the test piece having the cross section with each side of 40 mm and the thickness of 1.7 mm based on the standard according to JIS K7105 for convenience. This is because that the transmittance of all light beams and the Haze value change depending on the thickness of the material.

Accordingly, it is sufficient to confirm that a selected material is the same as the material of the present invention by molding the test piece having the square cross section with each side of 40 mm and the thickness of 1.7 mm.

In contrast, the inventors have verified the material of the present invention likewise using test pieces having the square cross section with each side of 40 mm and various thicknesses.

Figure 6:
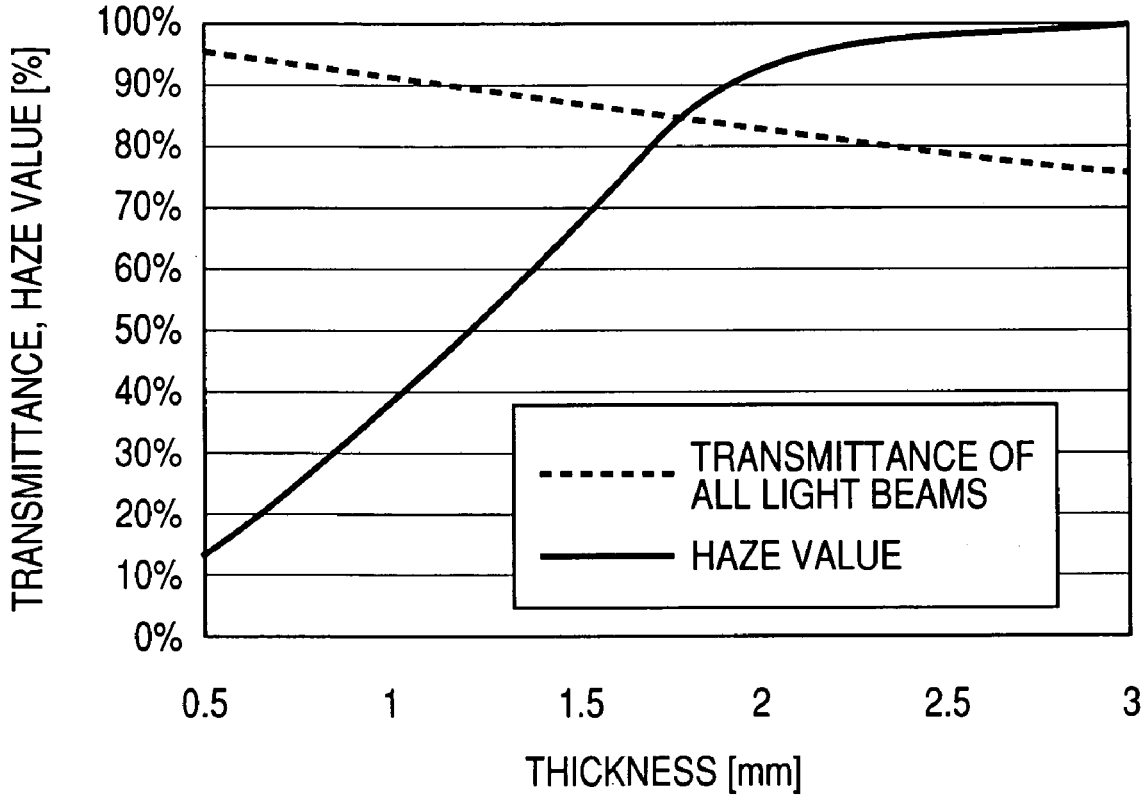
FIG. 6 is a graph showing the change of optical characteristics according to JIS J7136 when the thickness of a material of the present invention is changed.

Note that, as shown in FIG. 6, it can be found that when the material of the present invention is employed, the transmittance of all the light means and the Haze value exhibit a predetermined tendency as the thickness of the material changes.

Ink is poured into the ink tank such that at least the prism portion is dipped in the ink.

What is claimed is:

1. A liquid accommodation container for accommodating a liquid, comprising:

walls for constituting the liquid accommodation container;

a liquid accommodation chamber formed in the liquid accommodation container;

a liquid supply port formed through one of the walls of the liquid accommodation container for supplying the liquid accommodated in the container to the outside; and an optical member disposed on the one of the walls, wherein a light dispersing member is bonded on the surface of the optical member, wherein a part of the optical member faces inward of the liquid accommodation chamber and has a function for reflecting light, which is incident from the outside, to the outside when no liquid is present in the liquid accommodation chamber and not reflecting the light, which is incident from the outside, to the outside when the liquid is present in the liquid accommodation chamber, and when the optical characteristics of a material of the liquid accommodation container are measured based on a standard according to JIS K7105, the material has optical characteristics which are equivalent to the optical characteristics that a transmittance of all light beams is 80% or more and a Haze value is equal to or more than 75% and equal to or less than 85%.

2. A liquid accommodation container according to claim 1, wherein a measured sample is a rectangular parallelepiped which constitutes the liquid accommodation container and has a square cross section with each side of 40 mm and a thickness of 1.7 mm.

3. A liquid accommodation container according to claim 1, wherein the optical member is molded integrally with the liquid accommodation container.

4. A liquid accommodation container according to claim 3, wherein the optical member comprises an olefin resin material containing no clearing agent.

5. A liquid accommodation container according to claim 1, wherein the optical member has two reflection surfaces.

6. A liquid accommodation container according to claim 1, wherein the surface of the optical member is subjected to a non-mirror-finished surface treatment.

7. A liquid accommodation container for accommodating a liquid, comprising:

walls for constituting the liquid accommodation container;

a liquid accommodation chamber formed in the liquid accommodation container;

a liquid supply port formed through one of the walls of the liquid accommodation container for supplying the liquid accommodated in the container to the outside; and an optical member molded integrally with the liquid accommodation container on the one of the walls, wherein the optical member comprises an olefin resin material containing no clearing agent, wherein a part of the optical member faces inward of the liquid accommodation chamber and has a function for reflecting light, which is incident from the outside, to the outside when no liquid is present in the liquid accommodation chamber and not reflecting the light, which is incident from the outside, to the outside when the liquid is present in the liquid accommodation chamber, and when the optical characteristics of a material of the liquid accommodation container are measured based on a standard according to JIS K7105, the material has optical characteristics which are equivalent to the optical characteristics that a transmittance of all light beams is 80% or more and a Haze value is equal to or more than 75% and equal to or less than 85%.

8. A liquid accommodation container according to claim 7, wherein a measured sample is a rectangular parallelepiped which constitutes the liquid accommodation container and has a square cross section with each side of 40 mm and a thickness of 1.7 mm.

9. A liquid accommodation container according to claim 7, wherein the optical member has two reflection surfaces.

10. A liquid accommodation container according to claim 7, wherein the surface of the optical member is subjected to a non-mirror-finished surface treatment.

11. A liquid accommodation container according to claim 7, wherein a light dispersing sheet is bonded on the surface of the optical member.

* * * * *